US006836634B2

(12) United States Patent
Byun et al.

(10) Patent No.: US 6,836,634 B2
(45) Date of Patent: Dec. 28, 2004

(54) DEVELOPER UNIT OF ELECTROPHOTOGRAPHIC IMAGE FORMING APPARATUS

(75) Inventors: Seung-young Byun, Seongnam-si (KR); Jun-hee Cho, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/255,073

(22) Filed: Sep. 26, 2002

(65) Prior Publication Data

US 2003/0147675 A1 Aug. 7, 2003

(30) Foreign Application Priority Data

Feb. 7, 2002 (KR) ..... 2002-7029

(51) Int. Cl.[7] ..... G03G 15/08; G03G 15/09

(52) U.S. Cl. ..... 399/284; 399/103; 399/104; 399/274

(58) Field of Search ..... 399/98, 102, 103, 399/104, 274, 275, 284

(56) References Cited

U.S. PATENT DOCUMENTS 5,134,960 A * 8/1992 Shirai ..... 399/284 X
5,587,551 A * 12/1996 Ikegawa et al. ..... 399/284
6,049,689 A * 4/2000 Ishii et al. ..... 399/284
6,070,027 A * 5/2000 Kawai et al. ..... 399/103
6,336,015 B1 * 1/2002 Numagami ..... 399/104
6,341,206 B1 * 1/2002 Yamaguchi et al. ..... 399/103
6,574,444 B2 * 6/2003 Uehara et al. ..... 399/103

FOREIGN PATENT DOCUMENTS

KR 1999-84606 12/1999

* cited by examiner

*Primary Examiner*—Sandra Brase
(74) *Attorney, Agent, or Firm*—Staas & Halsey LLP

(57) ABSTRACT

A developer unit of an electrophotographic image forming apparatus includes a blocking blade having a magnetic fluid and a magnet. The magnetic fluid contacts a developer roller and the metering blade to prevent a developer from flowing to both ends of the metering blade. The magnetic fluid is fixed to the magnet which applies a pressure to the magnetic fluid so that the magnetic fluid contacts the developer roller and the metering blade. Since the magnetic fluid contacts the developer, wear of elements of the developer unit can be reduced, thereby securing durability of the developer unit. Also, a wrap-around phenomenon of the developer can be prevented.

19 Claims, 3 Drawing Sheets

DEVELOPER UNIT OF ELECTROPHOTOGRAPHIC IMAGE FORMING APPARATUS

CROSS-REFERENCE TO RELATED APPLICATIONS

This application claims the benefit of Korean Patent Application No. 2002-7029, filed Feb. 7, 2002, in the Korean Industrial Property Office, the disclosure of which is incorporated herein by reference.

BACKGROUND OF THE INVENTION

1. Field of the Invention

The present invention relates to an electrophotographic image forming apparatus, and more particularly, to a developer unit of an electrophotographic image forming apparatus whose structure is improved so as to prevent a wrap-around phenomenon of a developing solution occurring at both ends of a developer roller.

2. Description of the Related Art

An electrophotographic apparatus generally forms a latent electrostatic image on a photosensitive material, such as a photosensitive belt or a photosensitive drum, develops the latent electrostatic image into a visible toner image with toner having a predetermined color, and transfers the visible toner image to a sheet of paper to form a predetermined image.

The electrophotographic apparatus includes a developer unit, a transfer unit, and a fusing unit. The developer unit supplies toner to the photosensitive material to develop a latent electrostatic image formed thereon by a laser scanning unit into the visible toner image. The developer unit includes a developer roller, a deposit roller, and a metering blade. The developer roller is partially dipped into a developer contained in a developer container, is installed to rotate to be in contact with the photosensitive material, and supplies the developer to the photosensitive material. The deposit roller is dipped into the developer and deposits the developer on the developer roller using a difference in potential between the deposit roller and the developer roller. The metering blade controls a thickness of the developer that is attached onto the developer roller by the deposit roller.

The transfer unit is installed to rotate to be in contact with the photosensitive material. The transfer unit transfers the developed visible toner image formed on the photosensitive material to the paper disposed in a gap between the transfer unit and the photosensitive material.

The fusing unit fuses and fixes the transferred image on the paper by applying predetermined heat and pressure. The transfer unit may include a heat source so as to perform not only a transferring function but also a fusing and fixing function.

A paper supplying unit is installed to pick up the paper stacked in a cassette and supply the paper to the gap between the transfer unit and the photosensitive material. A paper discharging unit is installed to discharge the paper through the transfer unit and the fusing unit.

The metering blade is installed so as to contact the developer roller in a longitudinal direction of the developer roller and scrapes the developer to control the thickness of the developer that adheres to the surface of the developer roller by the deposit roller. Here, a portion of the developer scraped by the metering blade may leak out through both ends of the metering blade to the adjacent developer roller, which is called a "wrap-around phenomenon." The leaking developer may flow to the photosensitive material that contacts the developer roller and to the toner image formed on the photosensitive material. This may cause a cross contamination of the developer in color printing.

Accordingly, in the prior art, sponges having a low hardness are attached to both ends of the metering blade so as to prevent the wrap-around phenomenon of the developer.

However, it is difficult to attach sponges having the low hardness to the metering blade and to install the metering blade so as to attach precisely the sponges to the metering blade. Further, the sponges are worn out as time goes by, and thus the developer leaks out through both ends of the metering blade.

SUMMARY OF THE INVENTION

To solve the above and other problems, it is an object of the present invention to provide a developer unit of an electrophotographic image forming apparatus whose structure is improved so as to prevent a developer from wrapping around both ends of a developer roller.

Additional objects and advantageous of the invention will be set forth in part in the description which follows and, in part, will be obvious from the description, or may be learned by practice of the invention.

Accordingly, to achieve the above and other objects, there is provided a developer unit of an electrophotographic image forming apparatus. The developer unit includes a developer roller, a metering blade, and a blocking blade. The developer roller is installed to be partially dipped into a developer container and to rotate to supply a developer to a latent electrostatic image formed on a photosensitive material. The metering blade is installed to contact an outer circumference of the developer roller so as to control the developer attached to the outer circumference of the developer roller to a predetermined thickness. The blocking blade is installed between the developer roller and the metering blade to prevent a wrap-around phenomenon of the developer.

BRIEF DESCRIPTION OF THE DRAWINGS

The above object and advantages of the present invention will become more apparent and more readily appreciated from the following description of the preferred embodiment, taken in conjunction with the accompanying drawings of which.

DETAILED DESCRIPTION OF THE PREFERRED EMBODIMENTS

Figure 1:
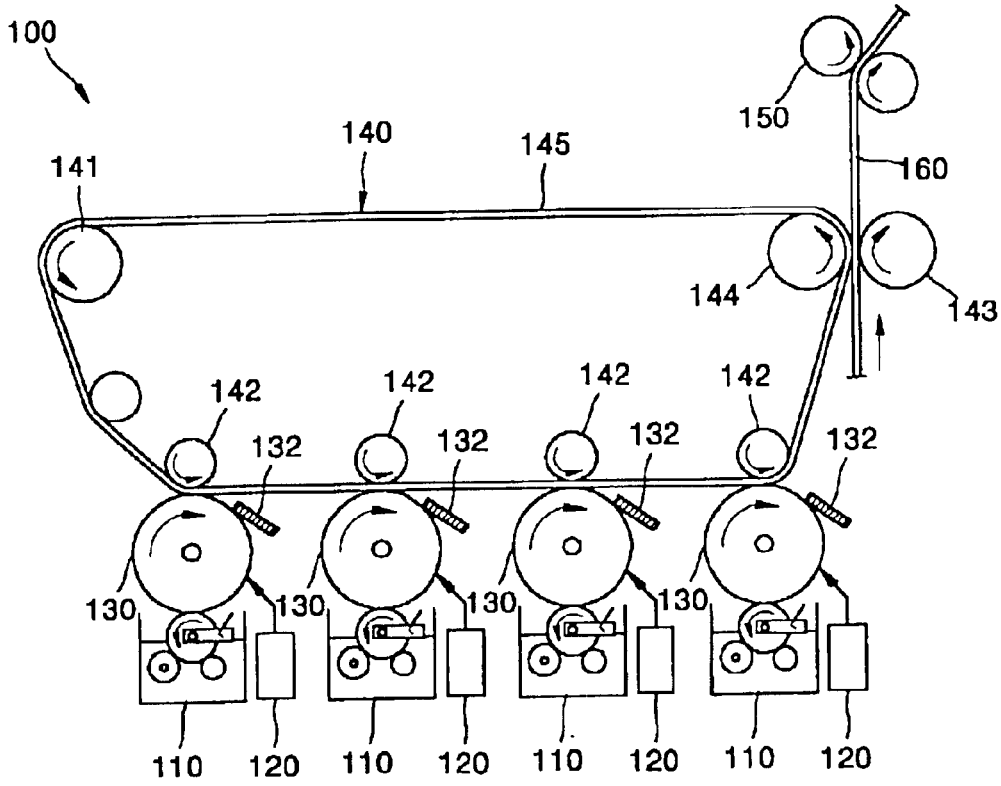
FIG. 1 is a cross-sectional view of an electrophotographic image forming apparatus having a developer unit according to an embodiment of the present invention.

Reference will now be made in detail to the present preferred embodiment of the present invention, examples of which are illustrated in the accompanying drawings, wherein like reference numerals refer to the like elements throughout. The embodiment is described in order to explain the present invention by referring to the figures.

Figure 2:
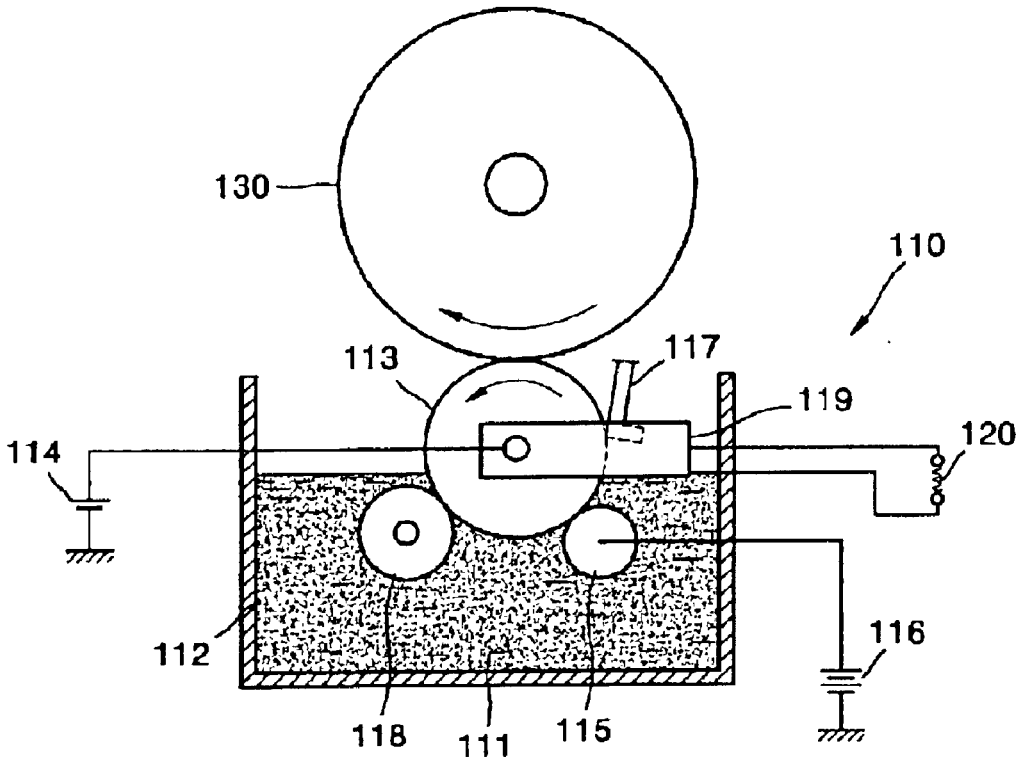
FIG. 2 is a cross-sectional view of the developer unit shown in FIG. 1.

FIG. 1 is a cross-sectional view of an electrophotographic image forming apparatus 100 having developer units 110 according to an embodiment of the present invention. FIG. 2 is a cross-sectional view of the developer unit 110 shown in FIG. 1.

Referring to FIG. 1, the electrophotographic image forming apparatus 100 uses a highly dense developer to form a desired image and includes the developer units 110, laser scanning units 120, a transfer unit 140, and a fusing roller 150.

The laser scanning units 120 form latent electrostatic images on respective photosensitive drums 130.

The transfer unit 140 is supported and rotated by a driving roller 141, transfer backup rollers 142, and a paper transfer backup roller 144. The transfer unit 140 includes a transfer belt 145 and a paper transfer roller 143. Visible toner images formed by the developer units 110 are transferred from the photosensitive drums 130 to the transfer belt 145 to form a toner image. The paper transfer roller 143 is disposed to correspond to the paper transfer backup roller 144 so as to place the transfer belt 145 between the paper transfer backup roller 144 and the paper transfer roller 143, and transfers the toner image to a sheet of paper 160.

The fusing roller 150 is installed in a path for discharging the paper 160 so as to fuse and fix the toner image on the paper 160 by applying predetermined temperature and pressure.

Cleaning blades 132 are installed to contact respective ones of the outer circumferences of the photosensitive drums 130 and remove the developer remaining on the photosensitive drums 130.

Referring to FIG. 2, each developer unit 110 supplies a developer 111 supplied from a developer tank (not shown) to the photosensitive drum 130 to develop the latent electrostatic image formed thereon into the visible toner image. The developer unit 110 includes a developing container 112, a developer roller 113, a deposit roller 115, a cleaning roller 118, a metering blade 117, and a blocking blade 119.

The developer container 112 contains the developer 111 supplied from the developer tank through a connection path (not shown).

The developer roller 113 is partially installed to be dipped into the developer 111 contained in the developer container 112, is connected to a developing power supply 114 to have a predetermined voltage, contacts the photosensitive drum 130 to rotate, and supplies the developer 111 to the photosensitive drum 130 to develop the latent electrostatic image formed thereon into corresponding visible toner image.

The deposit roller 115 is installed to be dipped into the developer 111 and is connected to a deposit power supply 116 to have a second predetermined voltage. The deposit roller 115 attaches the developer 111 to an outer circumference of the developer roller 113 using a difference in potential between the deposit roller 115 and the developer roller 113 connected to the developing power supply 114 to have the second predetermined voltage.

The deposit roller 115 may have a gap with the developer roller 113, may contact the developer roller 113, or may be installed to be fixed or rotate.

The cleaning roller 118 contacts the developer roller 113 to rotate and removes the developer 111 remaining on the outer circumference of the developer roller 113.

The metering blade 117 contacts the developer 111 attached to the outer circumference of the developer roller 113 and scrapes the developer 111 that adheres to the outer circumference of the developer roller 113 to control a thickness of the developer 111. Here, the scraped developer 111 leaks out at both ends of the metering blade 117 and contaminates both ends of the developer roller 113 that contacts the developer 111. As a result, a cross contamination, which contaminates the visible toner image formed on the photosensitive drum 130, occurs.

Figure 3:
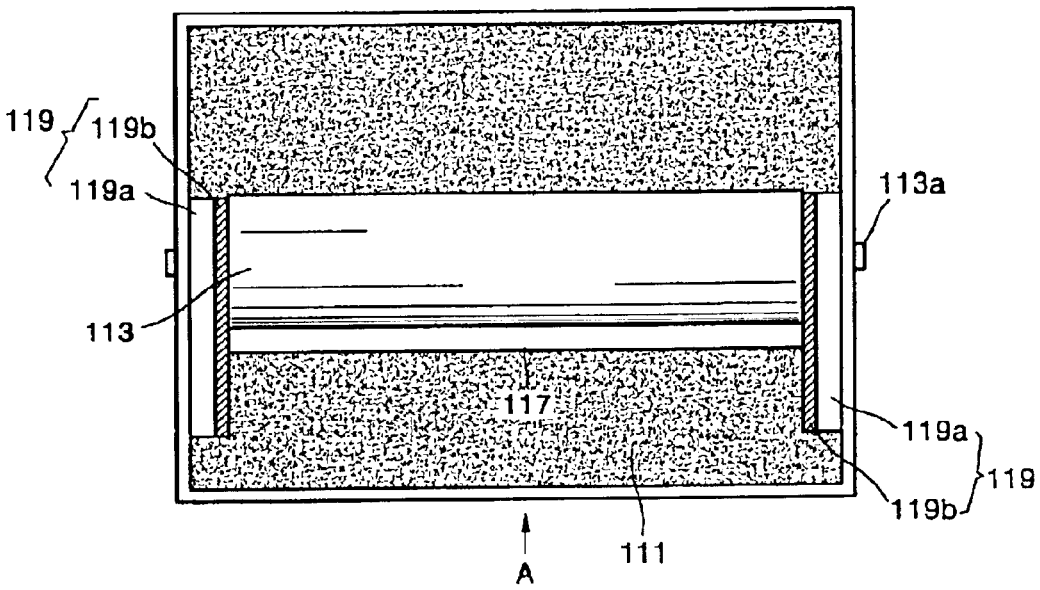
FIG. 3 is a plan view of the developer unit shown in FIG. 2.

FIG. 3 is a plan view of the developer unit 110 shown in FIG. 2. Referring to FIG. 3, the blocking blade 119, which prevents the cross contamination, has a magnet 119*a* and a magnetic fluid 119*b*.

The magnet 119*a* is spaced-apart from the developer roller 113 and the metering blade 117 and installed on a rotation shaft 113*a* of the developer roller 113 so that the rotation shaft 113*a* rotates together with the developer roller 113 while the magnet 119*a* does not rotate together with the rotation shaft 113*a* and the developer roller 113. The magnet 119*a* may be fixedly mounted on the developer container 112 to face an end portion of the metering blade 117. The magnet 119*a* has a predetermined magnetic force so as to apply a predetermined pressure to the magnetic fluid 119*b* to fix the magnetic fluid 119*b* to the magnet 119*a*. In other words, magnetic particles, such as ultra-fine ferromagnetic particles, contained in the magnetic fluid 119*b* are attracted by the magnetic force of the magnet 119*a* to generate the predetermined pressure so that the magnetic fluid 119*b* contacts the developer roller 113 and the metering blade 117 by the predetermined pressure. A magnitude of the predetermined pressure is controlled by a controller in accordance with a magnitude of an electrostatic force between the magnet 119*a* and the magnetic fluid 119*b*.

The magnetic fluid 119*b* is a fluid to which a surfactant is added so as not to settle or agglutinate the magnetic particles by stably distributing the magnetic particles in a colloid state when the magnetic particles dissolve in the magnetic fluid 119*b*. Here, the ultra-fine ferromagnetic particles are not separated from a liquid under a magnetic field, gravity, and a centrifugal force. The magnetic fluid 119*b* is apparently a liquid but operates like it has magnetism in a magnetic field.

Accordingly, the developer 111 cannot flow to the developer roller 113 and the metering blade 117 which contact the magnetic fluid 119*b*.

An ultrasonic generator 120 of FIG. 2 is further included to generate ultrasonic waves by supplying a current to the magnet 119*a*. The ultrasonic waves vibrate the developer 111 flowing to both ends of the metering blade 117 so as to more effectively block a flow of the developer 111 to an end of the developer roller 113 by using the magnetic fluid 119*b*.

An operation of the developer unit having the blocking blade 119 will be described with reference to FIGS. 2 and 4.

Figure 4:
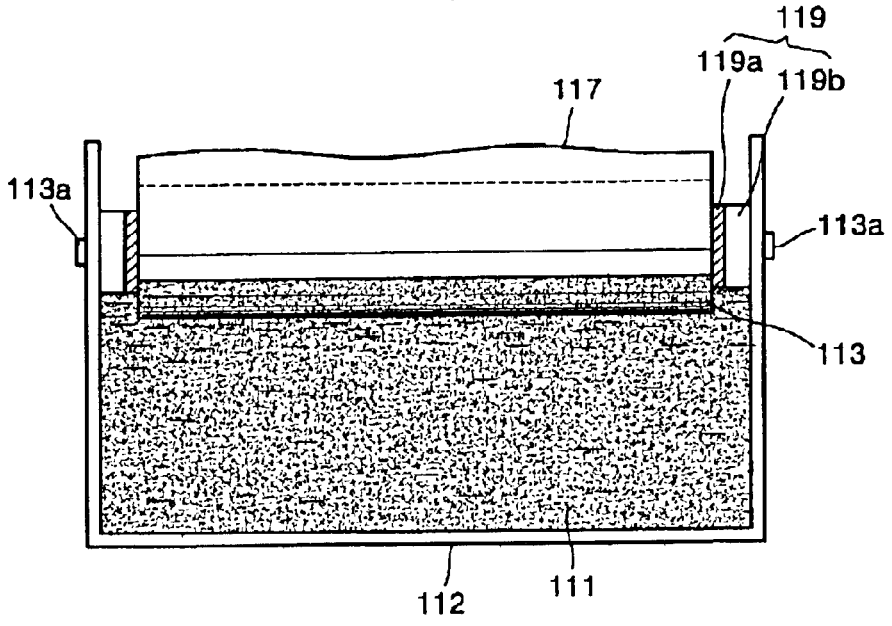
FIG. 4 is a side view of the developer unit shown in an A direction of FIG. 3 to explain an operation of a blocking blade shown in FIGS. 2 and 3.

FIG. 4 is a side view of the developer unit shown in an A direction of FIG. 3 to explain an operation of the blocking blade 119 shown in FIGS. 2 and 3. Referring to FIGS. 2 and 4, the deposit roller 115 connected to the deposit power supply 116 has the second predetermined voltage and attaches the developer 111 to the developer roller 113 using a difference in potential between the deposit roller 115 and the developer roller 113. In other words, the deposit roller 115 and the developer 111 have the same charge (in the present invention, positive charge) to attach the developer 111 to the outer circumference of the developer roller 113 using a repulsive force between the deposit roller 115 and the developer roller 111.

In this embodiment of the present invention, an amount of the developer 111 adhering to the outer circumference of the developer roller 113 is considerably larger than an amount necessary for developing the latent electrostatic image formed on the photosensitive drum 130. The excess developer 111 is scraped away from the developer roller 113 by the metering bladed 117 to the thickness, and a concentration thereof becomes higher.

A portion of the developer 111, which has been scraped by the metering blade 117, returns to the developer container 112 or flows to both ends of the metering blade 110 in a longitudinal direction of the metering blade 110.

The blocking blade 119, which is installed at one end of the metering blade 117, blocks the flow of the developer 111 to both ends of the metering blade 117. Thus, the developer 111 returns to the developer container 112 since the developer 111 cannot flow to both ends of the metering blade 117 any more.

The magnet 119*a* is connected to the ultrasonic generator 120. The ultrasonic generator 120 vibrates the developer 111 using the ultrasonic waves generated by applying the current to the magnet 119*a* so as to more effectively block the flow of the developer 111 to both ends of the metering blade 117.

The developer roller 113 supplies the developer 111 to the latent electrostatic image formed on the photosensitive drum 130 to form the visible toner image. Here, the developer 111 is not wholly supplied to the latent electrostatic image, but partially remains on the outer circumference of the developer roller 113. The remaining developer contacts the cleaning blade 118 to be removed.

As described above, in the developer unit of the electrophotographic image forming apparatus according to the present invention, the blocking blade having the magnetic fluid is installed to reduce wear of elements of the developer unit by using a contact between a liquid and another liquid, i.e., the magnetic fluid and the developer, thereby securing durability of the developer unit. Also, a wrap-around phenomenon of the developer can be prevented.

Although a few preferred embodiments of the present invention have been shown and described, it would be appreciated by those skilled in the art that changes may be made in this embodiment without departing from the principles and sprit of the invention, the scope of which is defined in the claims and their equivalents.

What is claimed is:

1. A developer unit of an electrophotographic image forming apparatus having a developer container and a photosensitive medium, comprising:

a developer roller to rotate to supply the developer to a latent electrostatic image formed on the photosensitive medium;

a metering blade installed to contact the developer attached to an outer circumference of the developer roller so as to control the developer attached to the outer circumference of the developer roller to a thickness; and a blocking blade installed between the developer roller and the metering blade to prevent a wrap-around phenomenon of the developer when the metering blade controls the thickness of the developer attached to the developer roller, wherein the blocking blade includes:

a magnetic fluid which contacts the developer roller and the metering blade to prevent the developer from flowing to both ends of the metering blade; and a magnet applying a pressure to the magnetic fluid to fix the magnetic fluid to the magnet so that the magnetic fluid contacts the developer roller and the metering blade.

2. The developer unit of claim 1, wherein the magnet comprises a permanent magnet.

3. A developer unit of an electrophotographic image forming apparatus having a developer container and a photosensitive medium, comprising:

a developer roller to rotate to supply the developer to a latent electrostatic image formed on the photosensitive medium;

a metering blade installed to contact the developer attached to an outer circumference of the developer roller so as to control the developer attached to the outer circumference of the developer roller to a thickness; and a blocking blade installed between the developer roller and the metering blade to prevent a wrap-around phenomenon of the developer when the metering blade controls the thickness of the developer attached to the developer roller, wherein the developer roller includes a rotation shaft, and the blocking blade is installed on the rotation shaft of the developer roller.

4. A developer unit of an electrophotographic image forming apparatus having a developer container and a photosensitive medium, comprising:

a developer roller to rotate to supply the developer to a latent electrostatic image formed on the photosensitive medium;

a metering blade installed to contact the developer attached to an outer circumference of the developer roller so as to control the developer attached to the outer circumference of the developer roller to a thickness;

a blocking blade installed between the developer roller and the metering blade to prevent a wrap-around phenomenon of the developer when the metering blade controls the thickness of the developer attached to the developer roller; and an ultrasonic generator controlling the developer to vibrate to prevent the developer from flowing to both ends of the developer roller, wherein the blocking blade includes:

a magnetic fluid which contacts the developer roller and the metering blade to prevent the developer from flowing to both ends of the metering blade; and a magnet applying a pressure to the magnetic fluid to fix the magnetic fluid to the magnet so that the magnetic fluid contacts the developer roller and the metering blade.

5. A developer unit of an electrophotographic image forming apparatus having a developer container and a photosensitive medium having a latent electrostatic image, comprising:

a developer roller disposed to supply the developer to the photosensitive medium to develop the latent electrostatic image with a developer contained in the developer;

a metering blade disposed along an outer circumferential surface of the developer in an axial direction of the developer roller to remove an excessive amount of the developer from the developer roller to control a thickness of the developer attached to the outer circumference of the developer roller; and a blocking blade disposed adjacent to the metering blade to separate the removed developer from the metering blade to prevent a wrap-around phenomenon of the developer and a cross-contamination of the photosensitive drum occurring when the removed developer flows to an end of the metering blade from the developer roller and is transferred to the photosensitive drum.

6. The developer unit of claim 5, wherein the blocking blade is disposed in a radial direction perpendicular to the axial direction of the developer roller.

7. The developer unit of claim 5, wherein the blocking blade is disposed at end portions of the developer roller and the metering blade.

8. The developer unit of claim 5, wherein the blocking blade has a length in a radial direction of the developer roller, and the length of the blocking blade is greater than a distance between the metering blade and the developer roller.

9. A developer unit of an electrophotographic image forming apparatus having a developer container and a photosensitive medium having a latent electrostatic image, comprising:

a developer roller disposed to supply the developer to the photosensitive medium to develop the latent electrostatic image with a developer contained in the developer;

a metering blade disposed along an outer circumferential surface of the developer in an axial direction of the developer roller to remove an excessive amount of the developer from the developer roller to control a thickness of the developer attached to the outer circumference of the developer roller;

a blocking blade disposed adjacent to the metering blade to separate the removed developer from the metering blade to prevent a wrap-around phenomenon of the developer and a cross-contamination of the photosensitive drum occurring when the removed developer flows to an end of the metering blade from the developer roller and is transferred to the photosensitive drum; and an ultrasonic generator supplying a current to the blocking blade and controlling the blocking blade to generate an ultrasonic wave vibrating the removed developer, which is attached to the metering blade after being removed from the developer roller, so as to separate effectively the removed developer from the metering blade.

10. A developer unit of an electrophotographic image forming apparatus having a developer container and a photosensitive medium having a latent electrostatic image, comprising:

a developer roller disposed to supply the developer to the photosensitive medium to develop the latent electrostatic image with a developer contained in the developer;

a metering blade disposed along an outer circumferential surface of the developer in an axial direction of the developer roller to remove an excessive amount of the developer from the developer roller to control a thickness of the developer attached to the outer circumference of the developer roller;

a blocking blade disposed adjacent to the metering blade to separate the removed developer from the metering blade to prevent a wrap-around phenomenon of the developer and a cross-contamination of the photosensitive drum occurring when the removed developer flows to an end of the metering blade from the developer roller and is transferred to the photosensitive drum;

a magnet disposed between the developer roller and the metering blade; and a magnetic fluid disposed at end portions of the magnet and the metering blade to separate the removed developer from the metering blade.

11. The developer unit of claim 10, wherein the magnetic fluid is attached to the magnet to contact the removed developer of the metering blade to separate the removed developer from the metering blade.

12. The developer unit of claim 10, the magnetic fluid comprises magnetic particles and a surfactant distributing the magnetic particles in a colloid state in the magnetic fluid.

13. The developer unit of claim 12, wherein the magnetic particles comprises ferromagnetic ultra-fine particles.

14. The developer unit of claim 10, wherein the magnet generates a magnetic force to the magnetic fluid to attract the magnetic fluid toward the magnet.

15. The developer unit of claim 14, wherein the magnet generates a pressure within the magnetic fluid by using the magnetic force to allow the magnetic fluid to contact the metering blade while being attached to the magnet, and the pressure corresponds to a magnitude of an electrostatic force between the magnet and the magnetic fluid.

16. The developer unit of claim 10, wherein the developer roller comprises a shaft, and the magnet comprises a first end, a second end extended from the first end, and a hole formed in the first end to receive the shaft of the developer roller.

17. The developer unit of claim 16, wherein the second end of the magnet is disposed adjacent to an end of the metering blade, and the magnetic fluid is disposed between the second end of the magnet and the end of the metering blade to contact the removed developer remaining on the metering blade.

18. The developer unit of claim 10, further comprising:

an ultrasonic generator connected to the magnet to generate an ultrasonic wave vibrating the removed developer, which remains on the metering blade after being removed from the developer roller, so as to separate effectively the removed developer from the metering blade.

19. A developer unit of an electrophotographic image forming apparatus having a developer container and a photosensitive medium having a latent electrostatic image, comprising:

a developer roller disposed to supply the developer to the photosensitive medium to develop the latent electrostatic image with a developer contained in the developer;

a metering blade disposed along an outer circumferential surface of the developer in an axial direction of the developer roller to remove an excessive amount of the developer from the developer roller to control a thickness of the developer attached to the outer circumference of the developer roller;

a blocking blade disposed adjacent to the metering blade to separate the removed developer from the metering blade to prevent a wrap-around phenomenon of the developer and a cross-contamination of the photosensitive drum occurring when the removed developer flows to an end of the metering blade from the developer roller and is transferred to the photosensitive drum;

first and second magnets disposed adjacent to first and second ends of the metering blade, respectively; and first and second magnetic fluids disposed between the first magnet and the first end of the metering blade and between the second magnet and the second end of the metering blade to separate the removed developer from the first and second ends of the metering blade, respectively.

* * * * *

UNITED STATES PATENT AND TRADEMARK OFFICE

CERTIFICATE OF CORRECTION

PATENT NO. : 6,836,634 B2
APPLICATION NO. : 10/255073
DATED : December 28, 2004
INVENTOR(S) : Seung-young Byun et al.

It is certified that error appears in the above-identified patent and that said Letters Patent is hereby corrected as shown below:

Column 6, line 68, add The Paragraph below after "photosensitive drum"

wherein the blocking blade includes:

a magnetic fluid which contacts the developer roller and the metering blade to prevent the developer from flowing to both ends of the metering blade; and a magnet applying a pressure to the magnetic fluid to fix the magnetic fluid to the magnet so that the magnetic fluid contacts the developer roller and the metering blade.

Column 8, line 5, replace "10, the" with --10, wherein the--

Signed and Sealed this

First Day of August, 2006

JON W. DUDAS
*Director of the United States Patent and Trademark Office*